US005349928A

United States Patent [19]

Takahashi et al.

[11] Patent Number: 5,349,928

[45] Date of Patent: Sep. 27, 1994

[54] AIR INTAKE ARRANGEMENT FOR A TWO-CYCLE ENGINE

[75] Inventors: Masatetsu Takahashi; Katsumi Torigai, both of Shizuoka, Japan

[73] Assignee: Sanshin Kogyo Kabushiki Kaisha, Shizuoka, Japan

[21] Appl. No.: 828,217

[22] Filed: Jan. 30, 1992

[30] Foreign Application Priority Data

Jan. 31, 1991 [JP] Japan ..... 3-029216
Feb. 1, 1991 [JP] Japan ..... 3-031418

[51] Int. Cl.[5] ..... F02M 35/10
[52] U.S. Cl. ..... 123/73 A; 123/184.34
[58] Field of Search ..... 123/52 MV, 55 VF, 55 VS, 123/55 VE, 73 A

[56] References Cited

U.S. PATENT DOCUMENTS 4,993,369 2/1991 Breckenfeld et al. ..... 123/52 MV
5,020,483 6/1991 Watanabe ..... 123/52 MV

FOREIGN PATENT DOCUMENTS 0423813 4/1991 European Pat. Off. ..... 123/52 MV

*Primary Examiner*—David A. Okonsky
*Attorney, Agent, or Firm*—Bacon & Thomas

[57] ABSTRACT

An improvement for use on a V-type two-cycle engine having two rows cylinders with air intake passages aligned generally symmetrically on either side of an engine crankshaft is disclosed wherein the attachment of the air intake passages to the engine crankcase is rigidified so as to suppress the vibrations generated by the air intake system. This structural interconnection can take the integrally forming the intake passages with the crankcase, securing the between the cylinder rows end a support member formed integral with the crankcase and/or supporting the intake passages to the crankcase at their upstream ends through an air intake box. In addition, the air intake passages may be integrally formed with bearing supports for the engine crankshaft to enable the crankcase to be formed from more than one piece which can be readily detached for inspection and maintenance purposes.

15 Claims, 7 Drawing Sheets

AIR INTAKE ARRANGEMENT FOR A TWO-CYCLE ENGINE

BACKGROUND OF THE INVENTION

1. Field of the Invention

The present invention generally pertains to a V-type two-cycle engine and, more particularly, to the air intake system of a two-cycle engine having a pressurized crank chamber.

2. Description of the Prior Art

V-type two-cycle engines, such as that represented by published Japanese patent application Hei 2-248628, are widely known in the art. This type of engine configuration includes two cylinder rows which are positioned approximately symmetrically on either side of a crankshaft to define the V-shape. In this type of two-cycle engine, separate air intake passages for each of the two cylinder rows are provided. In addition, a crankcase is attached to the cylinder block of each cylinder row to form a crank chamber therebetween.

A two-cycle engine constructed in a manner described above is subject to a short engine life for various reasons. For example, vibrations generated during operation of the engine tend to concentrate in the valley of the "V" formed by the cylinder rows. These vibrations must be absorbed by the cylinder block unless made very massive and heavy, cannot absorb these fatigue loads over a long period of time. Also, because the crank chamber is pressurized, there must be air intake connections on the side of the cylinders and in the crankcase for each of cylinder rows. These air intakes, when located on either side of the crankshaft in roughly symmetrical alignment, are also subjected to high vibrations from the intake system. These conditions invite the occurrence of poor seals in areas near the cylinder block and air intake passages, thereby causing decreased engine life.

Therefore, there exists a need in the art for a V-type two-cycle engine having a cylinder block and air intake arrangement which suppresses the vibrations in the air intake system to prevent decreased engine life yet which can be made smaller and lighter than known cylinder blocks.

SUMMARY OF THE INVENTION

The present invention provides a V-type two-cycle engine comprising a cylinder block having two cylinder rows with air intake passages for each row cylinders connected and proportioned substantially symmetrically on either side of the engine crankshaft. The crankshaft itself is supported by bearings within a pressurized crank chamber formed as part of the cylinder block. In one embodiment of the invention, the air intake passages are formed as separate units from the cylinder block and are fixedly secured to the crankcase. In another embodiment, the air intake passages are formed integral with the crankcase in a third embodiment, the crankcase is integrally formed with supports for the air intake passages. With these construction arrangements, the object of suppressing the vibrations in the air intake system in order to prevent decreased engine life can be achieved.

These and other objects of the present invention will become more readily apparent from the following detailed description of preferred embodiments thereof, when taken in conjunction with the drawings wherein like reference characters refer to corresponding parts in the several views.

DETAILED DESCRIPTION OF THE PREFERRED EMBODIMENTS

Figure 1:
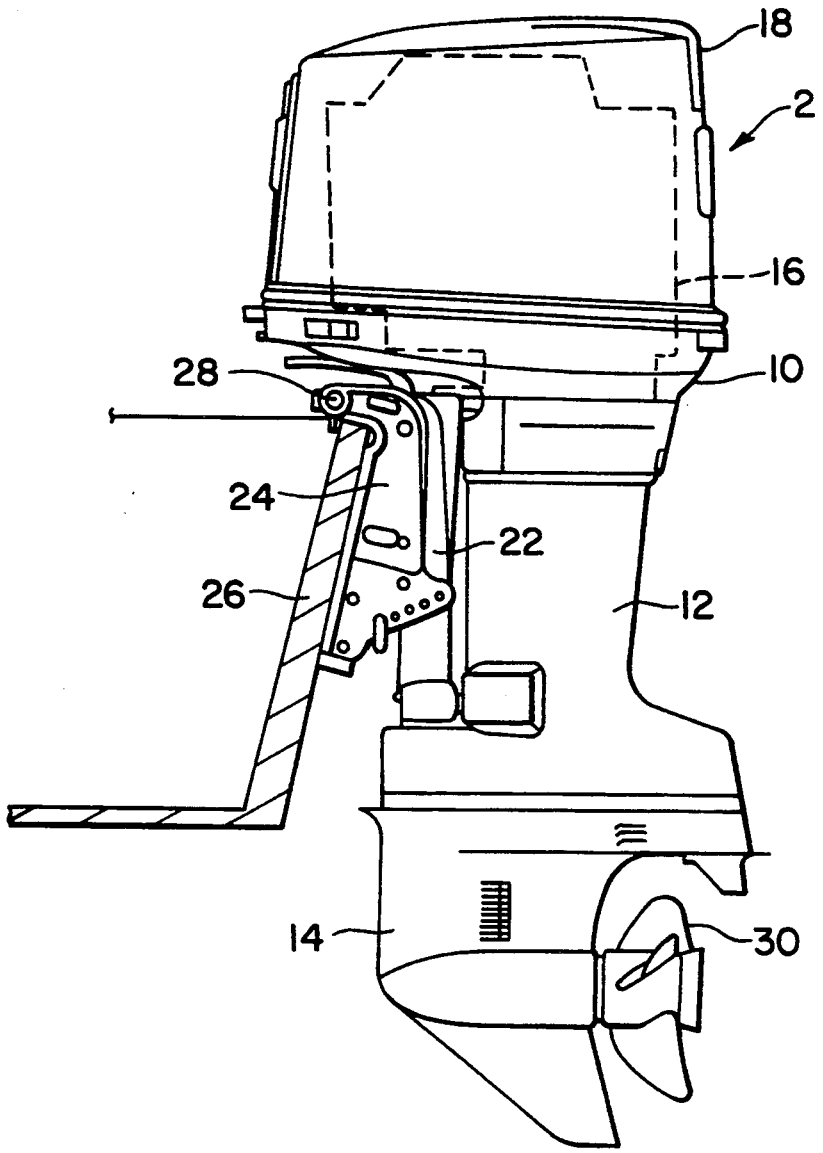
FIG. 1 depicts a side elevation view of a boat mounted marine outboard motor incorporating the engine arrangement of the present invention.

With initial reference to FIG. 1, a marine outboard engine unit incorporating the present invention is generally indicated at 2. Marine outboard engine unit 2 includes a bottom cowling 10, an upper casing 12 and a lower casing 14. Secured to bottom cowling 10 is a V-type two-cycle engine 16. In the preferred embodiment, engine 16 includes two cylinder rows each having three cylinders. Secured to bottom cowling 10 and covering engine 16 is an upper cowling 18. Outboard engine unit 2 is also equipped with a swivel bracket 22 which is pivotable relative to a clamp bracket 24 adapted to be secured to a transom 26 of a boat. Swivel bracket 22 defines a substantially upright axis about which outboard engine unit 2 may be rotated for steering purposes. In addition, swivel bracket 22 is pivotally attached to clamp bracket 24 through tilt shaft 28 which extends in a substantially horizontal direction, transverse with respect to the steering axis of outboard engine unit 2. As is known in the art, tilt shaft 28 permits outboard engine unit 2 to be pivoted thereabout in order to raise or lower outboard engine unit 2 relative to transom 26. As is also known in the art, outboard engine unit 2 includes a propeller 30 which is drivingly connected to an output shaft of engine 16.

Figure 2:
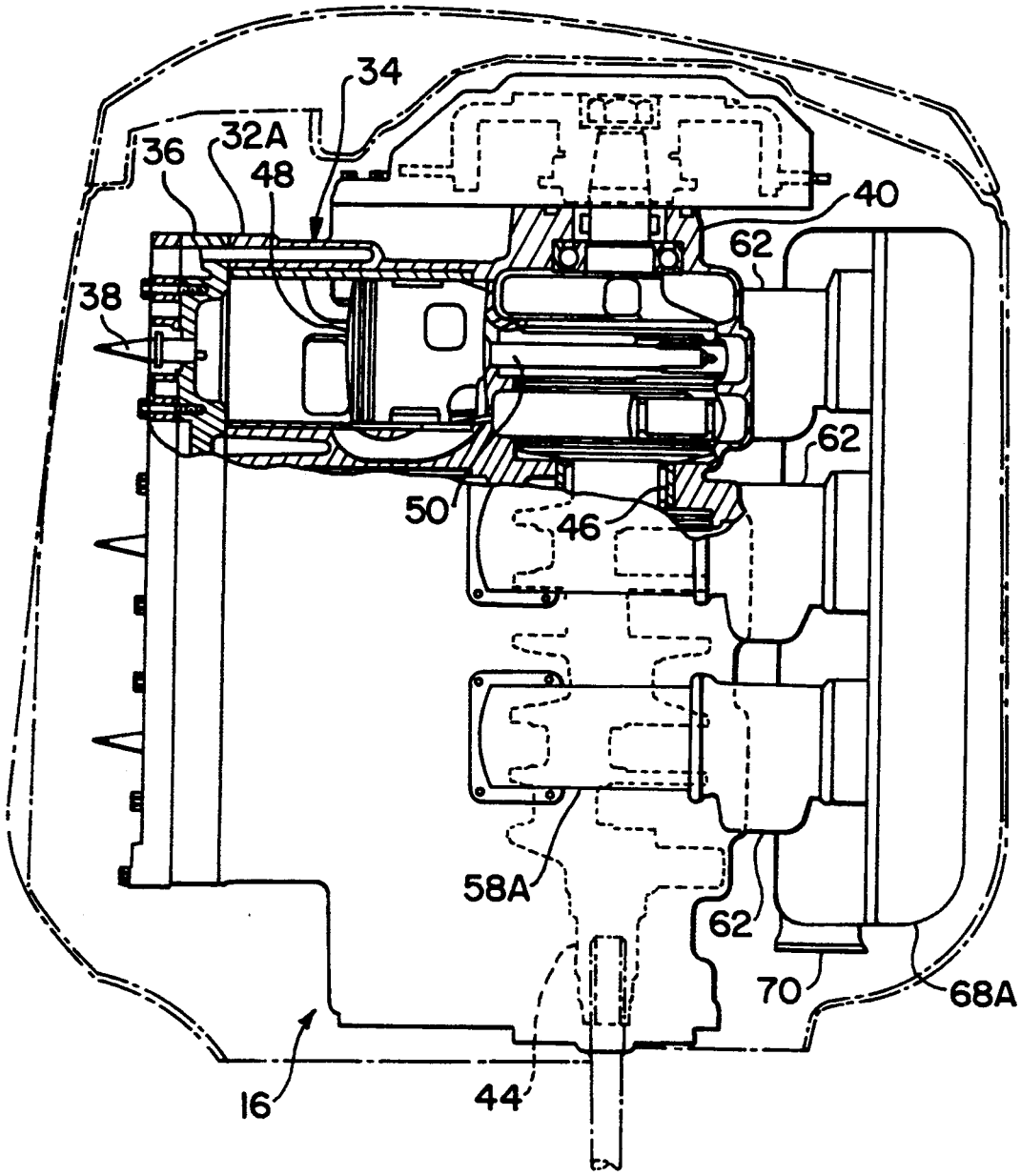
FIG. 2 is a partial cross-sectional side view of the engine shown in FIG. 1 according to a first embodiment of the present invention.
Figure 3A:
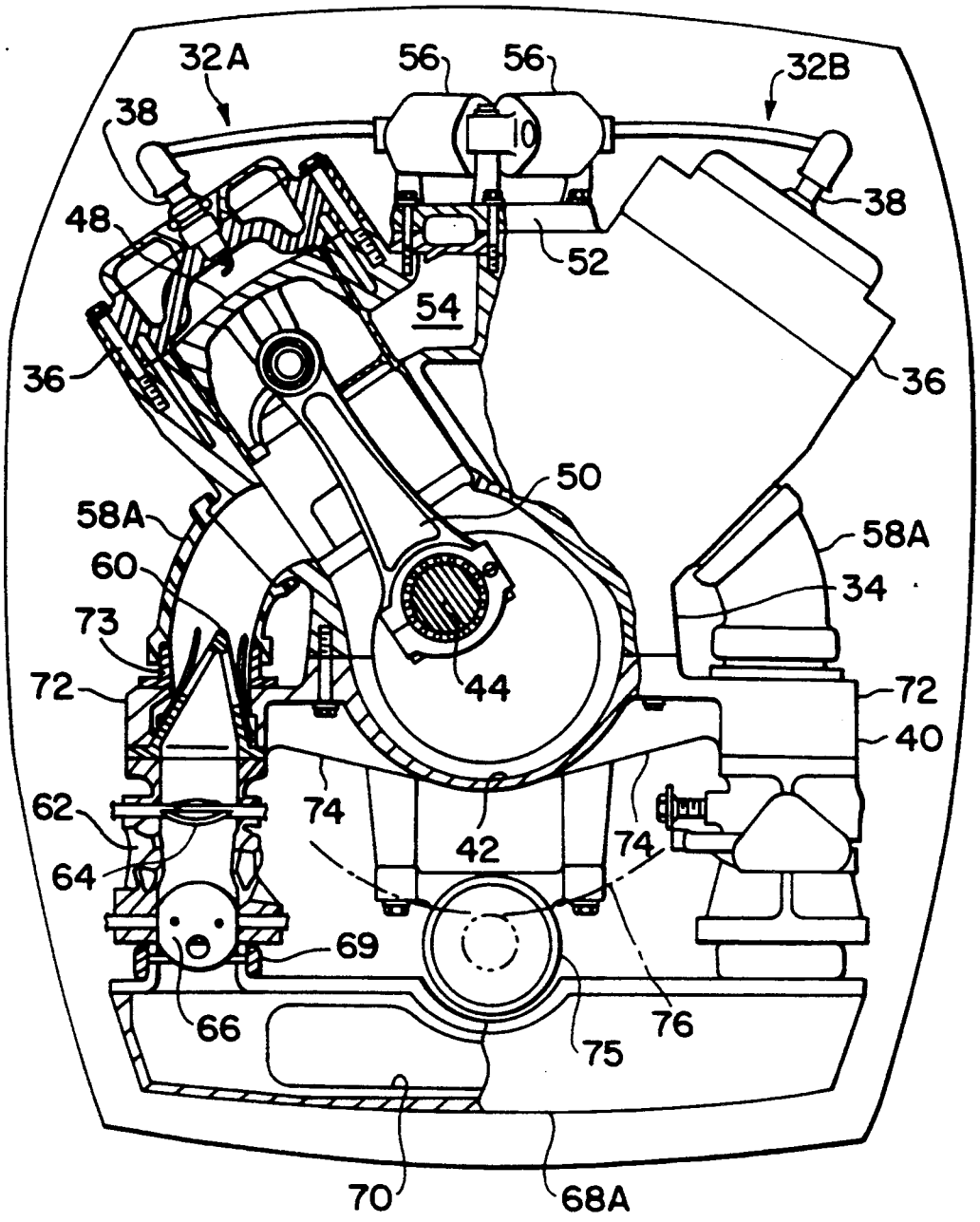
FIG. 3*a* is a top view of the engine shown in FIG. 2 in partial cross-section.

With reference to FIGS. 2 and 3*a*, detailed description of engine 16 along with e first embodiment of the invention will now be described. Engine 16 includes two rows of cylinders 32A, 32B which together form a V-shape and are integral with a common cylinder block 34. Each of the cylinder rows 32A, 32B are generally symmetrical and include a cylinder head 36 having apertures (not labeled) for spark plugs 38.

Engine 16 further includes a crankcase 40 which is attached to cylinder block 34 such that a crank chamber 42 is formed. Crank chamber 42 is open to the cylinders of cylinder rows 32A and 32B such that it is pressurized. Located with crank chamber 42 is a vertically disposed crankshaft 44. Crankshaft 44 is connected to a piston 48 located within each cylinder of cylinder rows 32A and 32B by means of respective wrist pins (not numbered) and connecting rods 50.

As best shown in FIG. 3*a*, between cylinder rows 32A and 32B of engine 16 is an exhaust cooling plate 52 which forms an exhaust passage 54 for each of the cylinders between the cooling plate 52 and cylinder block 34 (one being Shown in FIG. 3). Exhaust gases which enter exhaust passage 54 are guided to the lower casing 14 by exhaust expansion tubes (not shown) where they are expelled. In the preferred embodiment, exhaust cooling plate 52 is cooled by engine coolant and has ignition coils 56 for spark plugs 38 mounted thereon.

The air intake systems for each row of cylinders 32A, 32B are positioned left and right of the crankshaft 44 in a roughly symmetrical configuration. Intake tubes 58A, 58B are connected through respective reed valve units 60 to respective carburetor units 62. Each carburetor unit 62 includes a throttle valve 64 and a choke valve 66, Each carburetor unit 62 is connected to the upstream side of the air intake passages for each of the cylinder rows 32A, 32B. Carburetor units 62 are securely fastened to an air intake box 68A via seals 69. Air enters air intake box 68A from an air intake opening 70 formed in its bottom surface.

As shown in FIG. 3*a*, crankcase 40 is integrally formed with a plurality of air intake tube support mounts 72. In this embodiment, the intake tubes 58A, 588 are formed from an elastomeric material such as rubber and each air intake tube 58A, 58B extends between a respective air intake support 72 to an outside surface of cylinder block 34. For instance, air intake tube 58A is secured to air intake support 72 by a connector 73. Also, each of the carburetor units 62 of cylinder rows 32A, 32B are connected to the air intake box 68A through a seal member 69. In this embodiment, air intake box 68A is preferably made from cast aluminum so as to be sufficiently strong to support carburetor units 62.

As also shown in FIG. 3*a*, extending between each air intake tube support mount 72 and crankcase 40 are a plurality of ribs 74. By this arrangement, the air intake passages formed by the air intake tubes 58A, 58B and carburetor units 62 are supported by air intake tube support 72 which are formed integral with crankcase 40. Therefore, vibrations from the intake system are suppressed and each of the carburetor units 62 are firmly held in place by the air intake box 68A, which allows air intake system vibrations to be even further reduced.

Figure 3B:
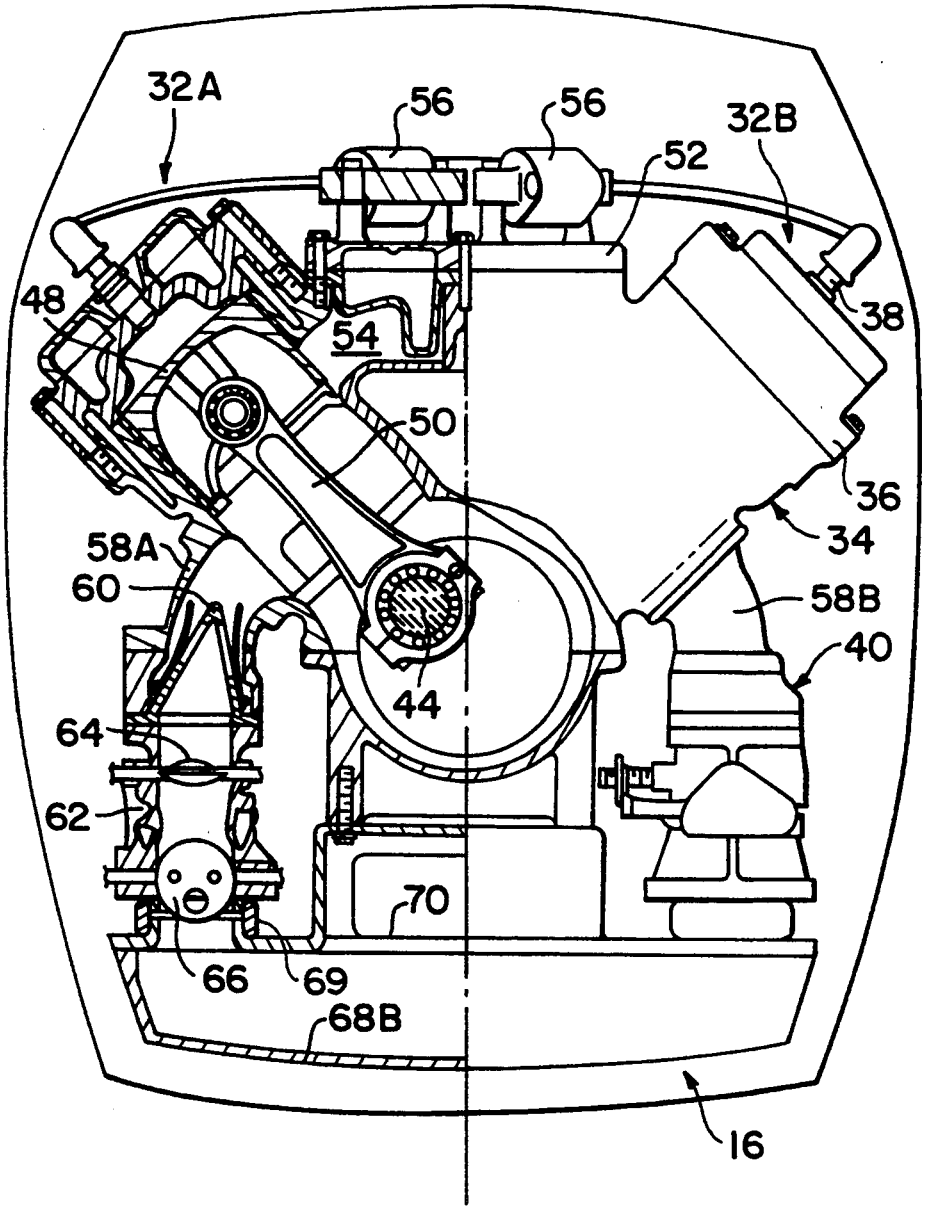
FIG. 3*b* is a top view of an engine in partial cross-section according to a second embodiment.

The FIG. 3*b* embodiment differs from that shown in FIG. 3*a* in treat intake tubes 58A, 58B are fixedly secured between a respective cylinder row 32A, 32B and a carburetor unit 62. The air intake box 68B is fabricated from die caste aluminum and is fixedly attached to pillars (not labeled) formed integral with crankcase 40 by any means known in the art such as screws. According to this embodiment, each air intake tube 58A, 58A and its corresponding carburetor unit 62 are firmly supported by the crankcase 40 upstream at the air intake box 68.

Figure 3C:
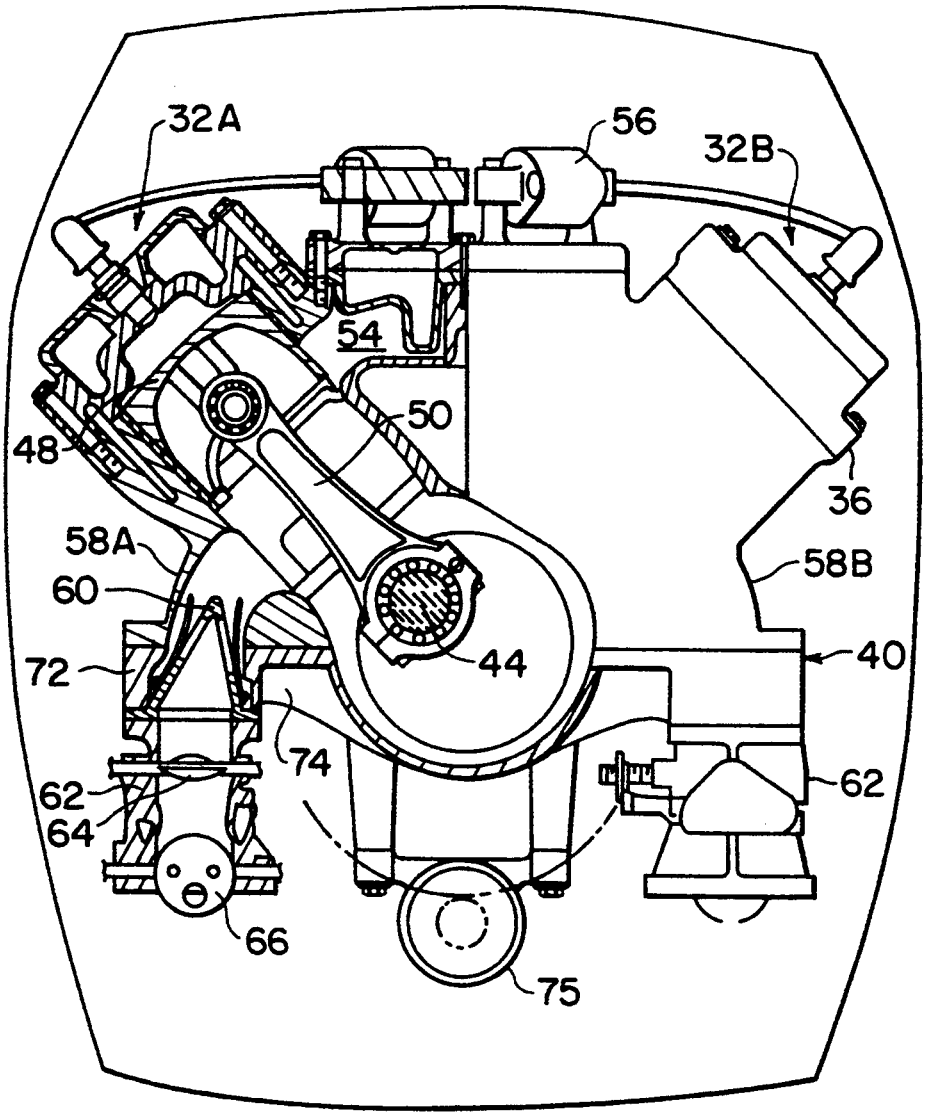
FIG. 3*c* is a top view of an engine in partial cross-section according to a third embodiment.

In the FIG. 3*c* embodiment, the intake tubes 58A, 58B are integrally formed with crankcase 40 to form the air intake passage along with integrally formed supports 72 having ribs 74 generally analogous to that described with respect to the embodiment shown in FIG. 3*a*. This arrangement serves to increase the strength of crankcase 40 overall, especially the strength in the bending direction along the center line of crankshaft This Figure also depicts, as does FIG. 2, a starter motor 75 which, as commonly known, includes a pinion (not shown) which projects outwardly when engine 16 is to be started so as to engage a ring gear 76 on a flywheel magnet attached to an upper end of crankshaft 44.

Figure 4:
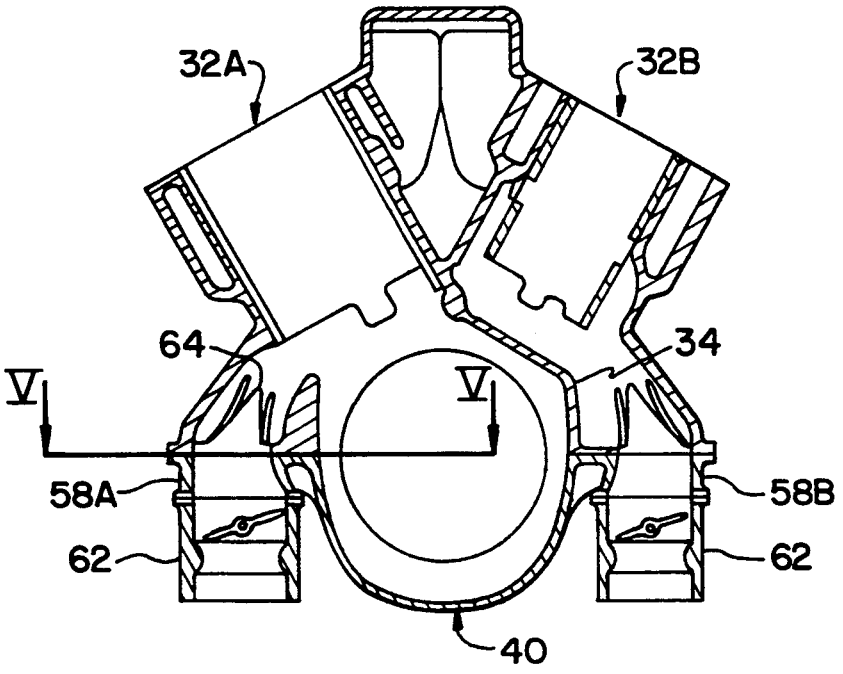
FIG. 4 is a partial cross-sectional top view of an engine according to a fourth embodiment of the invention.

At this point, it should be recognized that although each of the embodiments described above incorporate carburetor units 62, it should be understood that fuel injection units could also be used without departing from the spirit or scope of the present invention. The specifics of the embodiment shown in FIGS. 4 and 5 will now be described. The partial top view of the engine shown in FIG. 4 is similar to that shown and described with reference to FIG. 3*c* except that the reed valve assembly 64 is formed integral with crankcase 40 and is located within cylinder block 34. This arrangement minimizes the size of engine 16 and further enhancing the structural rigidity.

Figure 5:
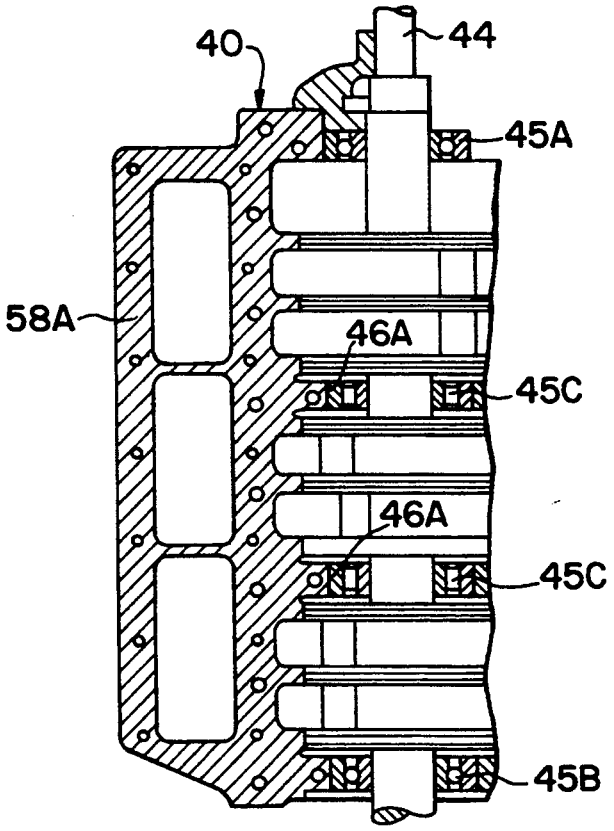
FIG. 5 is a cross-sectional view taken along line V—V in FIG. 4.

FIG. 5 shows the rotational support arrangement for crankshaft 44 within engine 16. As shown, crankshaft 44 is supported by bearings 45A, 45B at the adjoining surfaces between cylinder block 34 and crankcase 40 and by bearings 45C positioned in two places along crankshaft 44. According to this embodiment, the bearing caps 46 for bearings 45C are formed integral with crankcase 40 as shown.

Figure 6:
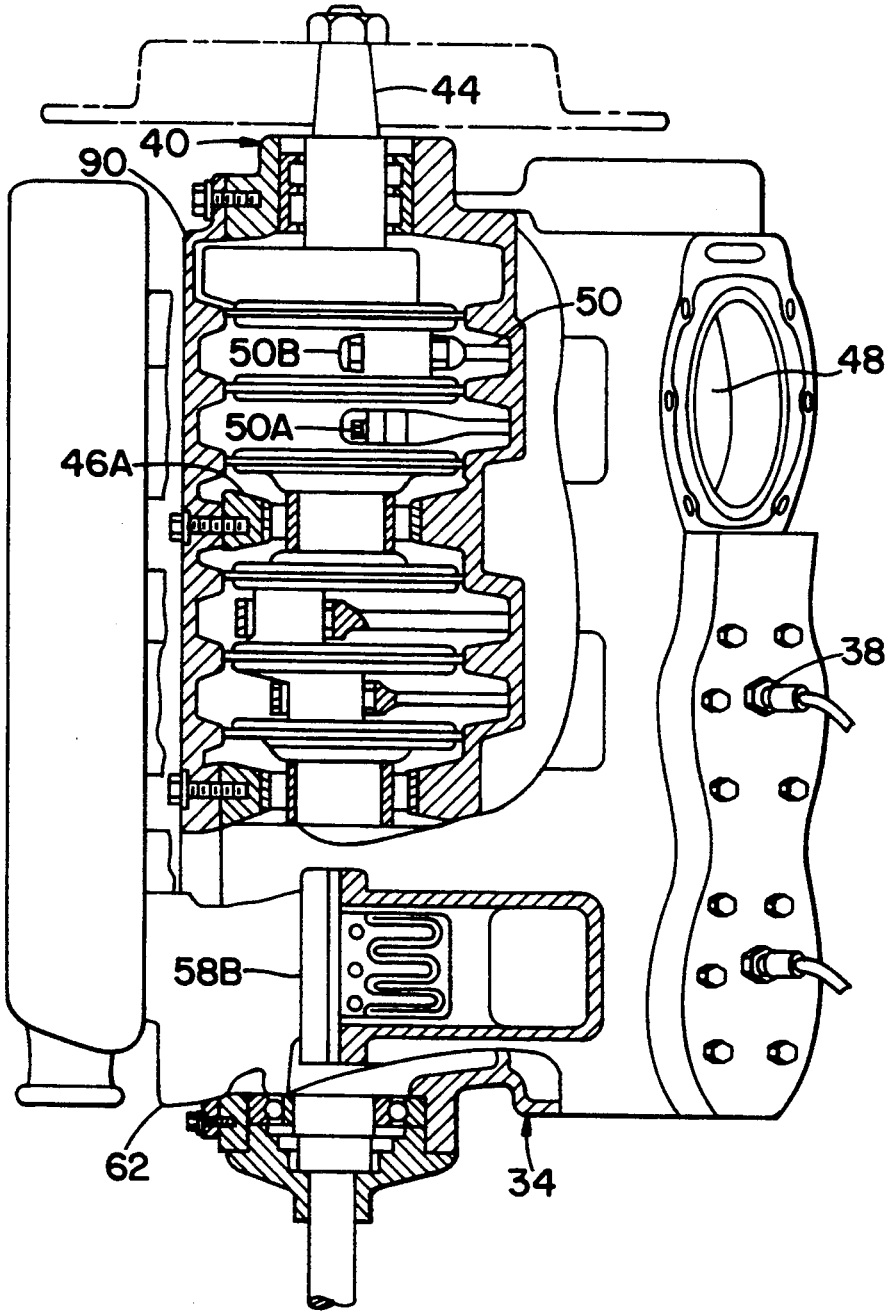
FIG. 6 depicts a partial cross-sectional side view of an engine incorporating a second aspect of the present invention.

FIG. 6 depicts another support arrangement for crankshaft 44 according to the present invention and will now be described in detail. In this embodiment, air intake tubes 58A, 58B have been formed integral with various crank bearing caps 46A. Bearing caps 46A function to support bearings 45C in a manner analogous to that shown and described with reference to FIG. 5. In the FIG. 6 embodiment, crankcase 40 includes a cover 90 which encapsulates crankshaft 44 to form crank chamber 42. Therefore, in this embodiment, crankcase 40 is formed from two separate elements which are bolted together. Also shown in FIG. 6 is the connection of connecting rods 50 to crankshaft 44. This connection is made through control rod bolts 50A and control rod caps 50B. Since cover 90 can be readily removed, it is possible to access control rod bolts 50A and control rod caps 50B without removing the crankcase 40B from the cylinder block 34. Furthermore, it is possible to withdraw pistons 48 and control rods 50 in the direction of the cylinder head 36 so as to simplify piston head control rod inspection.

From the description of the preferred embodiments given above, it can readily be seen that the present invention provides for increased rigidity of engine 16 so as to enable suppression of air intake vibrations created. This can be done in various ways such as forming the air intake integral with the crankcase, fixedly securing the air intake to a support member formed integral with the crankcase and/or supporting the upstream ends of the air intakes to the crankcase through an air intake box. In addition, the air intake tubes can be integrally formed with bearing supports for the engine crankshaft so as to enable the crankcase to be formed from more than one piece which can be readily detached for inspection and maintenance purposes.

Although described with respect to the preferred embodiments shown, it should be understood that various changes and/or modifications can be made to the embodiments described above without departing from the spirit and scope of the present invention as encompassed in the following claims.

We claim:

1. An air intake arrangement for use in a V-type two-cycle engine having a cylinder block with first and second cylinder rows, a crankcase interconnecting the cylinder rows and a crankshaft rotatably mounted within a crank chamber defined by said crankcase, said air intake arrangement comprising first and second air intake passages for supplying air to the first and second cylinder rows respectively said first and second air intake passages being substantially symmetrically aligned on either side of the crankshaft, each of said first and second air intake passages including a first end portion attached to the cylinder block and a second end portion supported by the crankcase.

2. An air intake arrangement as claimed in claim 1, further including first and second support members carried by the crankcase on opposite sides of the crank chamber, each of said first and second air intake passages being supported adjacent their second end portions by a respective one of said first and second support members.

3. An air intake arrangement as claimed in claim 2, wherein intake air for the engine flows through said first and second support members.

4. An air intake arrangement as claimed in claim 2, wherein at least a portion of each of said first and second air intake passages is formed from an elastomeric material.

5. An air intake arrangement as claimed in claim 2, further including a plurality of reinforcement ribs extending between each of said first and second support members and the crankcase.

6. An air intake arrangement as claimed in claim 1, further including an air intake box which is secured to the second end portions of said first and second air intake passages.

7. An air intake arrangement as claimed in claim 6, further including first and second carburetor units fixedly secured to and comprising said first and second intake passages respectively, said air intake box being fixedly secured between said carburetor units.

8. An air intake arrangement as claimed in claim 6, wherein said air intake box is fixedly secured to the crankcase.

9. An air intake arrangement as claimed in claim 8, wherein the crankcase is integrally formed with a plurality of pillars to which; said air intake box is secured.

10. An air intake arrangement as claimed in claim 1, further including a reed valve and a reed valve holder assembly located within each of said first and second air intake passages.

11. An air intake arrangement as claimed in claim 10, wherein each of said reed valve holder assemblies is integrally formed as part of said crankcase.

12. An air intake arrangement as claimed in claim 11, wherein said reed valve holder assemblies extend into the cylinder block.

13. An air intake arrangement as claimed in claim 1, further comprising at least one bearing cap for rotatably supporting the crankshaft, said at least one bearing cap being integrally formed with at least a portion of said first and second air intake passages.

14. An air intake arrangement as claimed in claim 13, wherein said crankcase includes a readily detachable cover member.

15. An air intake arrangement as claimed in claim 14, wherein said cover member opens into said crank chamber.

* * * * *